US008091805B2

(12) United States Patent
Paterson

(10) Patent No.: US 8,091,805 B2
(45) Date of Patent: Jan. 10, 2012

(54) SPLIT-FLOW PRE-FILMING FUEL NOZZLE

(75) Inventor: Clark Paterson, Loveland, CO (US)

(73) Assignee: Woodward, Inc., Fort Collins, CO (US)

( * ) Notice: Subject to any disclaimer, the term of this patent is extended or adjusted under 35 U.S.C. 154(b) by 205 days.

(21) Appl. No.: 11/943,796

(22) Filed: Nov. 21, 2007

(65) Prior Publication Data

US 2009/0126687 A1 May 21, 2009

(51) Int. Cl.
*B05B 7/12* (2006.01)

(52) U.S. Cl. ..... 239/408; 239/397.5; 239/403; 239/406; 239/422; 239/423

(58) Field of Classification Search ..... 239/69, 239/397.5, 398, 400, 403, 406, 408, 422, 239/423, 424
See application file for complete search history.

(56) References Cited

U.S. PATENT DOCUMENTS

| | | | | |
|---|---|---|---|---|
| 3,866,413 | A * | 2/1975 | Sturgess | 239/400 |
| 4,595,143 | A * | 6/1986 | Simmons et al. | 239/406 |
| 6,547,163 | B1 * | 4/2003 | Mansour et al. | 239/422 |
| 6,688,534 | B2 * | 2/2004 | Bretz | 239/398 |

FOREIGN PATENT DOCUMENTS

| | | | |
|---|---|---|---|
| DE | 41 27 455 | A1 | 2/1993 |
| EP | 1736707 | A2 | 12/2006 |
| GB | 2 198 521 | A | 6/1988 |
| JP | 02-275207 | A | 11/1990 |
| JP | 8049513 | A | 2/1996 |
| JP | 08-261464 | A | 10/1996 |

OTHER PUBLICATIONS

U.S. Appl. No. 12/233,671, filed Sep. 19, 2008, Lee et al.
U.S. Appl. No. 12/233,697, filed Sep. 19, 2008, Hicks et al.
U.S. Appl. No. 12/194,597, filed Aug. 20, 2008, Smith.
U.S. Appl. No. 12/199,376, filed Aug. 27, 2008, Hicks.
U.S. Appl. No. 12/569,996, filed Sep. 30, 2009, Smith.

* cited by examiner

*Primary Examiner* — Steven J Ganey
(74) *Attorney, Agent, or Firm* — Reinhart Boerner Van Deuren P.C.

(57) ABSTRACT

Presented is a pre-filming fuel nozzle that is readily manufacturable and consists of a fuel injector, a nozzle insert that fits over the fuel injector outlet, and a housing that generally encloses the fuel injector and nozzle insert. The housing has an atomizing lip, a fuel inlet passage, and an air passage. The nozzle insert has openings near the fuel injector that allows air to flow into the insert. During operation, the fuel injector impinges fuel on an inner surface of the insert and is pulled towards the atomizing lip from air flow through the insert. The air flow through the insert and air flow through the housing join at the atomizing lip, resulting in air flows shearing fuel droplets off of the atomizing lip. The nozzle may have swirler means such as a swirler fin and/or swirler passages on the insert to aid in swirling the air flow.

16 Claims, 6 Drawing Sheets

SPLIT-FLOW PRE-FILMING FUEL NOZZLE

BACKGROUND

Steady state combustors are used in various applications from gas turbine engines, various furnaces and heaters, and more recently, diesel engine exhaust after-treatment. These combustors maintain a constant or steady state flame in order to release energy from a fuel.

Steady state combustors can operate off of gaseous, liquid, or in some cases, solid fuels. Liquid fuel operation has several challenges for steady state combustors. In order to operate at maximum efficiencies and stabilities, The liquid fuel must be atomized with a nozzle into very small droplets. The atomization process allows the fuel to vaporize in as short a time as possible after leaving the nozzle. The fuel vapor must also mix with an oxidizer, such as air, as quickly as possible.

Methods have been developed to enhance fuel. Air-blast and air-assist nozzles are employed for the atomization of liquid fuels into minute droplets in an air atmosphere suitable for rapid and efficient combustion. These nozzles have very good atomization characteristics across very wide fuel flow rates, referred to as a good turn-down ratio. The airflow through the nozzle can also be directed in such a way that it can be used for atomization of the fuel liquid, vaporization of the liquid fuel droplets, mixing of the fuel vapor, and combustion of the fuel and oxidizer mixture. Because of the importance of the nozzle airflows in the fuel preparation and combustion process, the aerodynamics of the nozzle can be a critical factor of the nozzle design. Historically, this has produced nozzles that have had to incorporate expensive and complex geometries in order to meet the aerodynamic and fuel pattern requirements of the combustor.

BRIEF SUMMARY

Described herein is, among other things, a pre-filming fuel nozzle that is readily manufacturable and that is capable of minimizing and/or eliminating the aforementioned problems.

The pre-filming fuel nozzle consists of a fuel injector, a nozzle insert adapted to fit over an output of the fuel injector, and a housing. The nozzle insert has openings near the fuel injector. The housing has a fuel inlet passage for providing fuel to the fuel injector, and an air passage for air to enter the housing. During operation, fuel from the fuel injector impinges on an inner surface of the nozzle insert where it forms a film. The film is pulled towards the atomizing lip of the insert by air flow through the nozzle insert. The air flow through the nozzle insert and air flow through the housing join at the atomizing lip of the insert, resulting in air flows shearing fuel droplets off of the atomizing lip.

In one embodiment, the fuel injector is a pulse-width modulated fuel injector. In a further embodiment, the nozzle has swirler means such as a swirler fin and/or swirler passages on the nozzle insert.

Additional features and advantages will be made apparent from the following detailed description of illustrative embodiments, which proceeds with reference to the accompanying figures.

BRIEF DESCRIPTION OF THE DRAWINGS

The accompanying drawings incorporated in and forming a part of the specification illustrate several aspects of the split flow pre-filming air assist/air blast nozzle described herein, and together with the description serve to explain the principles of the nozzle. In the drawings.

While the nozzle will be described in connection with certain embodiments, there is no intent to limit it to those embodiments. On the contrary, the intent is to cover all alternatives, modifications and equivalents as included within the spirit and scope of the nozzle as defined by the appended claims.

DETAILED DESCRIPTION

There are generally two primary categories of fuel nozzles—air assist nozzles and air blast nozzles. Air-assist and air-blast nozzles are only separated by the flow quantity of air. The nozzle described herein can be used with a wide range of airflows that allows it to operate in both categories. For example, the fuel nozzle operates in one embodiment in a diesel engine exhaust environment that uses diesel fuel for combustion with constraints of large turn down ratios of fuel flow greater than 15:1 and low fuel pressure. The resulting fuel droplets in such an environment can be less than 50 μm in size using the fuel nozzle.

The fuel nozzle shall be described via operation as a pre-filming air-blast nozzle. During operation, fuel is metered onto a surface uniformly. High velocity air flows on both sides of the surface towards an atomizing edge of the surface, resulting in fuel being carried towards the atomizing edge of the surface by friction with flowing air or momentum of the fuel film. At the atomizing edge, the high velocity air on both sides of the surface meet, resulting in fuel droplets being "ripped" off the surface.

Figure 1A:
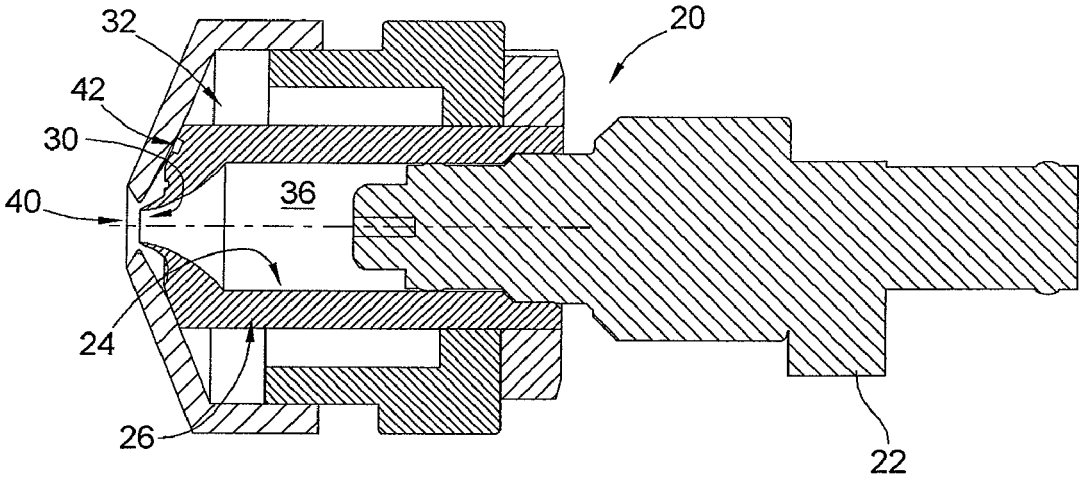
FIG. 1A is a simplified cross-sectional view of a nozzle in accordance with the teachings herein.
Figure 1B:
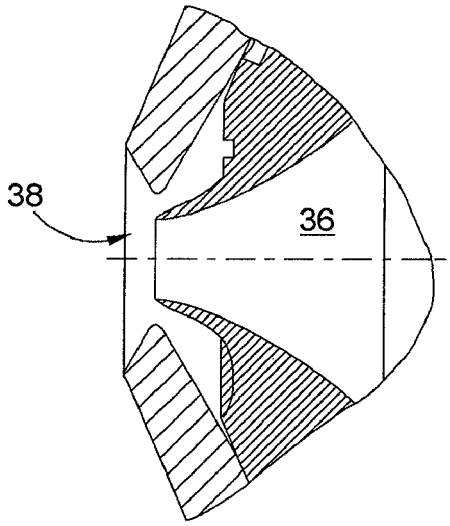
FIG. 1B is an enlarged cross-sectional view of part of the nozzle of FIG. 1A illustrating tangential holes therein.
Figure 2A:
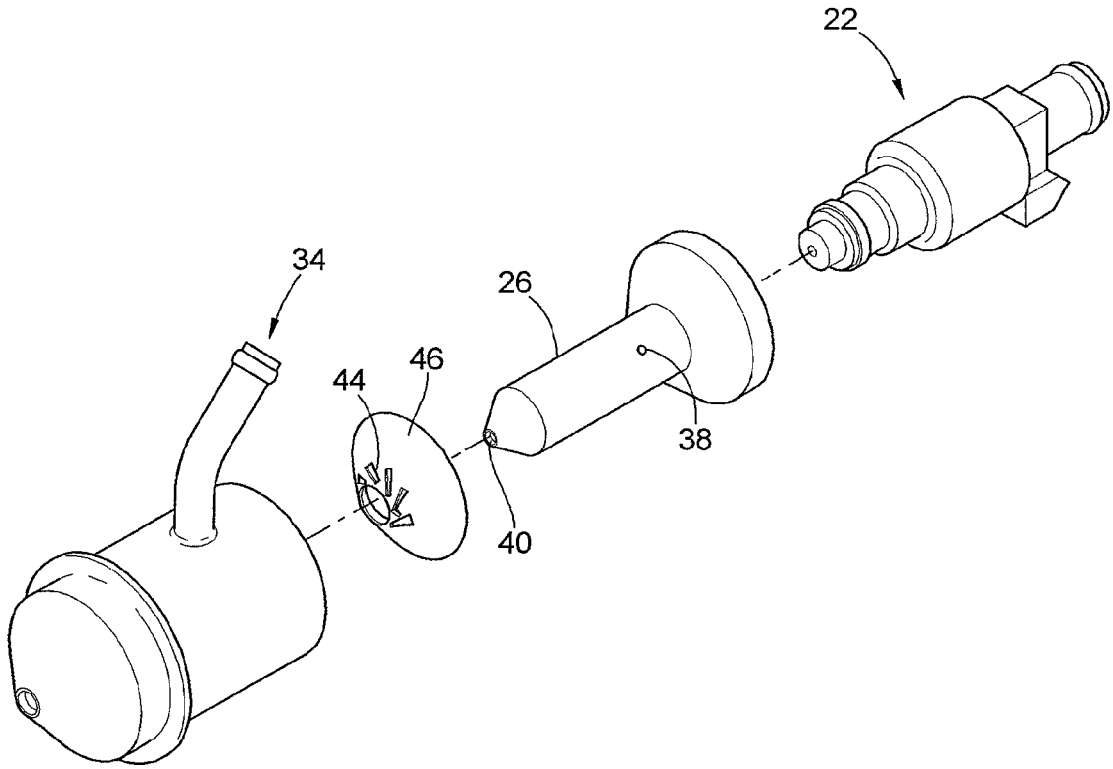
FIG. 2A is an assembly view of a portion of the components of a nozzle in accordance with the teachings herein.
Figure 2B:
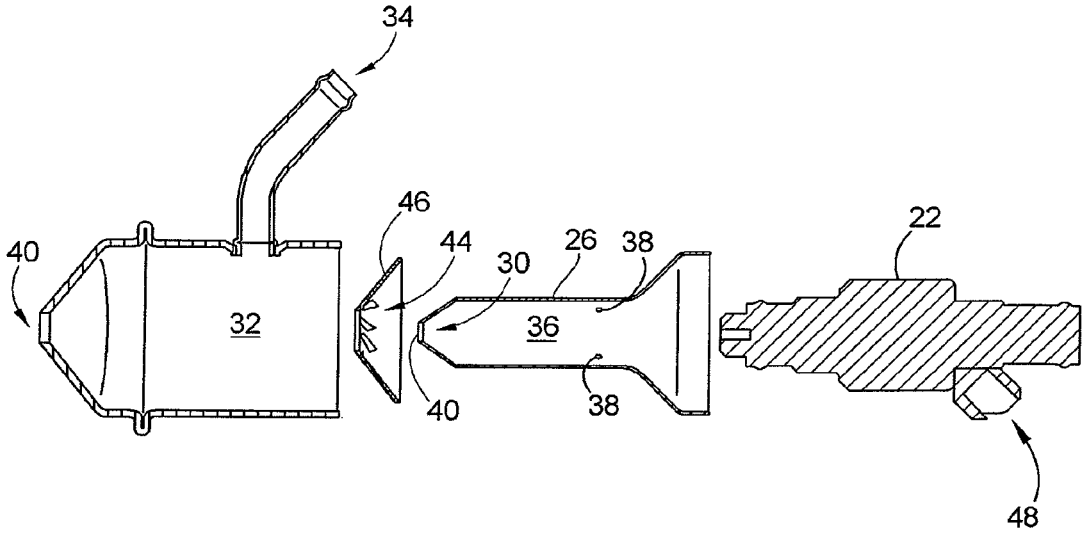
FIG. 2B is a cross-sectional view of the components of FIG. 2*a;*
Figure 2C:
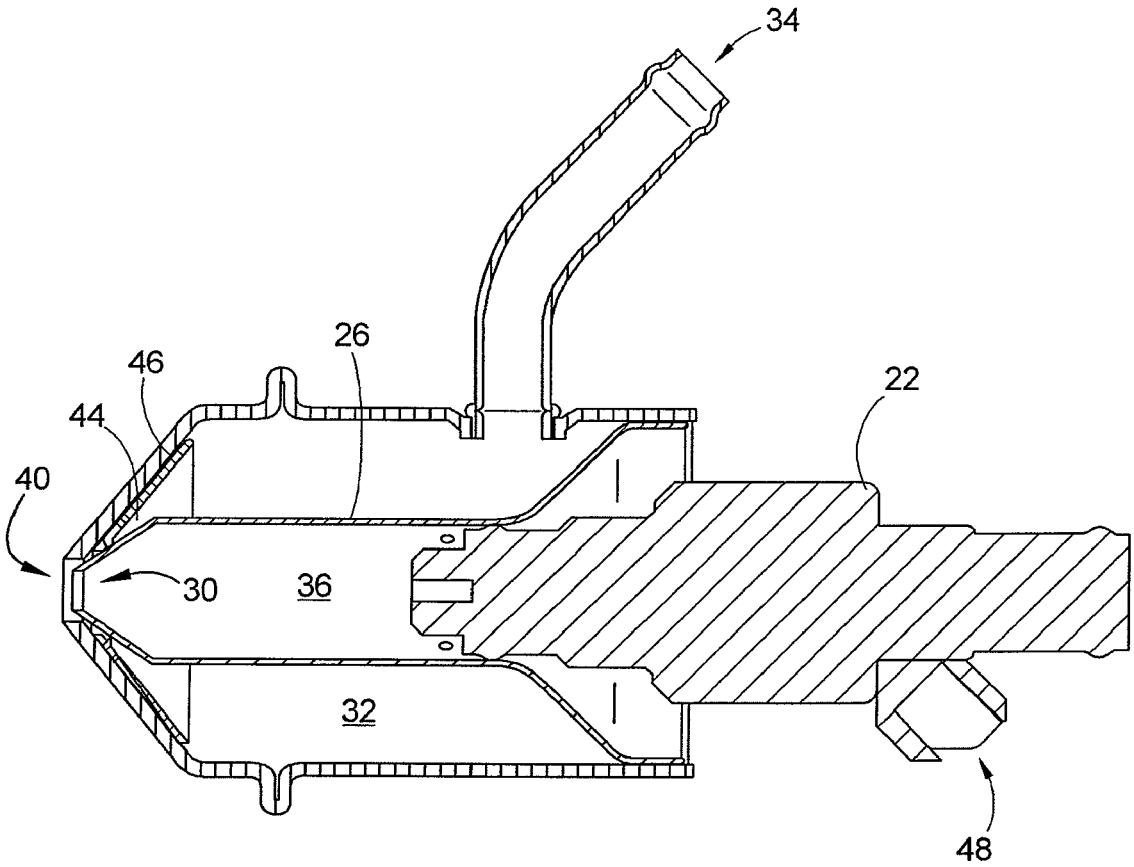
FIG. 2C is a cross-sectional view of the components of FIG. 2*a* when assembled.
Figure 2D:
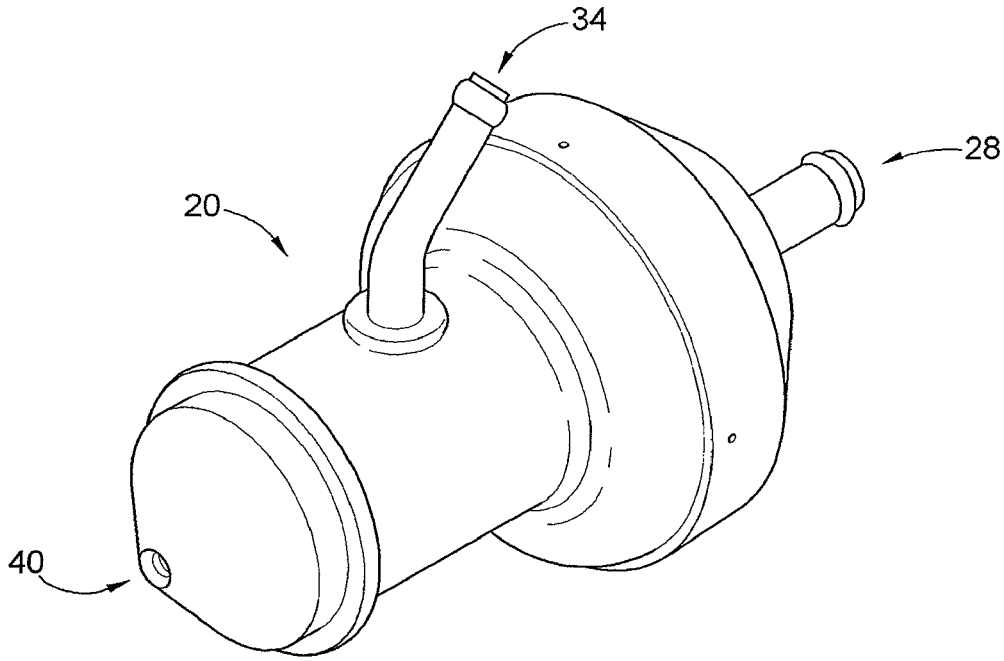
FIG. 2D is an isometric view of the nozzle of FIG. 2*a;*
Figure 2E:
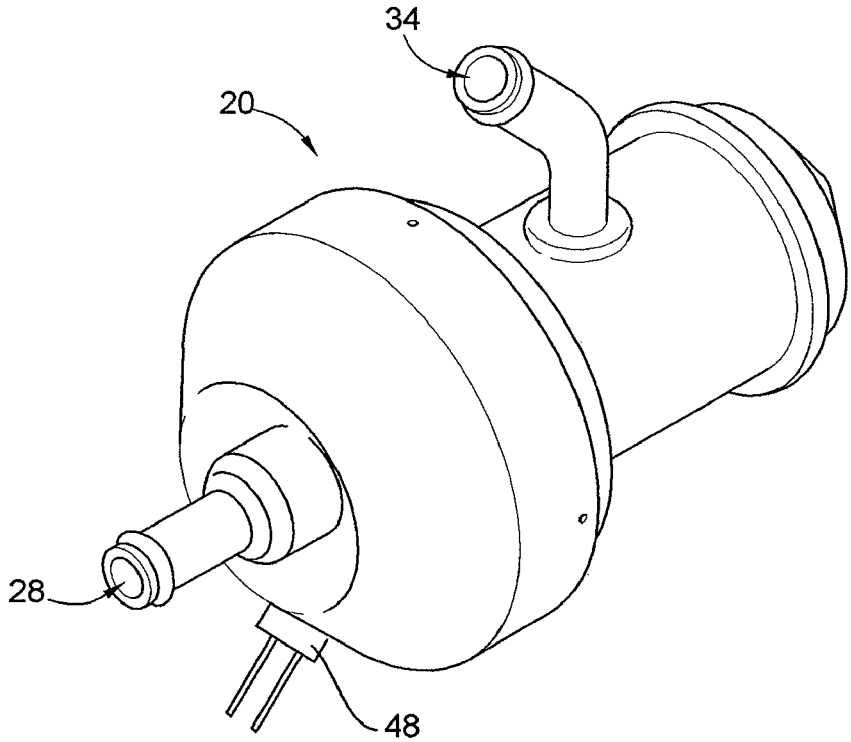
FIG. 2E is an alternate view of the nozzle of FIG. 2*a;*.
Figure 3:
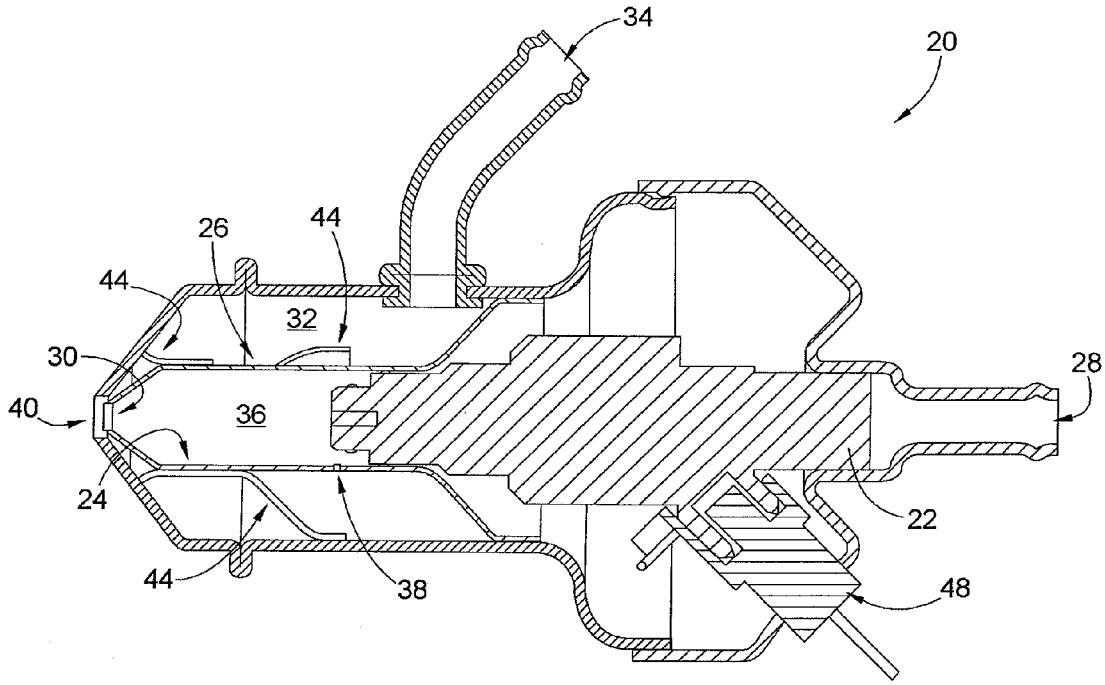
FIG. 3 is a cross-sectional view of an alternate embodiment of a nozzle in accordance with the teachings herein.

Turning now to FIGS. 1-3, a fuel injector 22 is used to provide fuel metering in the nozzle 20. In one embodiment, an automotive style PWM fuel injector is used. The fuel injector 22 allows large turndown ratios of flow and is only used as a metering device to get the fuel onto the filming surface 24 of nozzle insert 26. The nozzle insert 26 fits onto the injector 22, thereby changing the nozzle 20 to operate as a pre-filming air-assist/air-blast nozzle.

The nozzle operation is "detached" from injector droplet size. The injector needs only to wet the inner surfaces 24 of nozzle insert 26 with fuel that enters the injector though passage 28. The nozzle will work as long as the fuel spray impinges on the inner nozzle surfaces 24. Airflow pulls the fuel film along the inner chamber surface 24 towards the nozzle exit 30. Assist air enters the outer chamber 32 through a tangential opening 34 and swirls around the insert 26. Some of the assist air passes to the center chamber 36 of the insert 26 through tangential holes 38 in insert 26 near the tip of the injector 22. Air in the center chamber 36 swirls towards the nozzle exit 30 along the wetted fuel surface and takes the fuel film towards the atomizing lip 40. The remainder of the assist air stays in the outer chamber 32. In one embodiment, the air in the outer chamber 32 passes through swirling passages 42 that are cut in the insert 26. In another embodiment, swirler fins 44 are used to swirl the air flow. In the embodiment shown in FIGS. 2*a*-2*e*, the swirler fins 44 are formed in swirler plate 46. The outer chamber air flow maintains high velocity at the atomizing lip 40 and dictates flow patternization. The inner chamber air flow and outer chamber air flow join at the atomizing lip, resulting in the air flows shearing fuel droplets off of the atomizing lip 40. Initial droplet direction is also determined by the air flows. The nozzle 20 has an opening for an interface 48 that interfaces the fuel injector 22 with a controller (not shown). The controller may be a separate controller for the fuel nozzle, part of a system controller, etc.

Another aspect of the nozzle design is that the air provides thermal protection for the injector 22 and the fuel-wetted inner surface 24. The inner surface must be kept below a safe temperature to prevent fuel coking. For example, with diesel fuel, a safe temperature would generally be below approximately 130° C. The nozzle uses the injector as a metering device and improves the performance range over which small droplet atomization can be achieved. The air-assist/blast configuration creates very small droplets over a large fuel flow range when compared to using a conventional fuel injector. Note that the nozzle can be used with or without swirl and in a burner application or as a simple fuel doser system. Note that the ability of air-blast and air-assist nozzles to create very specific spray characteristics has led to the adaptation of these nozzles to many more applications than combustors. As such the nozzle described herein can be used for many applications that requires small droplet sizes across a wide liquid flow rate and has a source of atomizing gas. Some of these applications include paint sprayers, hydrocarbon dosers, Urea dosers, etc.

From the foregoing, it can be seen that the pre-filming fuel nozzle described is readily manufacturable. The housing generally consists of two sections 48, 50, which allows the fuel injector 22 and nozzle insert 26 to be readily mounted within the housing.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pre-filming fuel nozzle comprising a fuel injector;

a nozzle insert adapted to fit over an output of the fuel injector; the nozzle insert having openings near the fuel injector; and a housing having an atomizing lip, a fuel inlet passage for providing fuel to the fuel injector, and an air passage for air to enter a chamber in the housing, the chamber in air communication with the openings, whereby during operation, fuel from the fuel injector impinges on an inner surface of the nozzle insert and is pulled towards the atomizing lip from air flow through the nozzle insert from the chamber, the air flow through the nozzle insert and air flow through the chamber joining at the atomizing lip, resulting in air flows shearing fuel droplets off of the atomizing lip.

2. The pre-filming fuel nozzle of claim 1 wherein the fuel injector is a pulse-width modulated fuel injector.

3. The pre-filming nozzle of claim 1 further comprising swirler fins attached to the nozzle insert.

4. The pre-filming nozzle of claim 1 wherein the nozzle insert has swirler passages.

5. The pre-filming nozzle of claim 1 wherein the housing is a two-piece housing.

6. The pre-filming nozzle of claim 1 wherein the air flow through the chamber has a higher velocity at the atomizing lip than the air flow through the nozzle insert.

7. The pre-filming nozzle of claim 1 wherein the housing has an interface opening for an interface that interfaces the fuel injector to a controller.

8. The pre-filming nozzle of claim 1 wherein the air flow through the chamber and the air flow through the nozzle insert provides thermal protection for the fuel injector.

9. The pre-filming nozzle of claim 1 wherein the fuel injector is configured to operate as a fuel doser in a fuel doser system.

10. A pre-filming fuel nozzle comprising a fuel injector;

a nozzle insert adapted to fit over an output of the fuel injector; the nozzle insert having openings near the fuel injector;

a housing for enclosing the fuel injector and the nozzle insert, the housing having an atomizing lip, a fuel inlet passage for providing fuel to the fuel injector, and an air passage for air to enter the housing and the openings, whereby during operation, fuel from the fuel injector impinges on an inner surface of the nozzle insert and is pulled towards the atomizing lip from air flow through the nozzle insert from the housing, the air flow through the nozzle insert and air flow through the housing joining at the atomizing lip, resulting in air flows shearing fuel droplets off of the atomizing lip; and swirler means for swirling the air flow through a portion of the housing.

11. The pre-filming nozzle of claim 10 wherein the swirler means comprises swirler passages formed on the nozzle insert.

12. The pre-filming nozzle of claim 10 wherein the swirler means comprises swirler fins.

13. The pre-filming nozzle of claim 12 wherein the swirler fins are attached to the nozzle insert.

14. The pre-filming fuel nozzle of claim 10 wherein the fuel injector is a pulse-width modulated fuel injector.

15. The pre-filming nozzle of claim 10 the housing has an interface opening for an interface that interfaces the fuel injector to a controller.

16. A pre-filming fuel nozzle comprising a fuel injector;

a nozzle insert adapted to fit over an output of the fuel injector; the nozzle insert having openings near the fuel injector;

a housing for enclosing the fuel injector and the nozzle insert the housing having an atomizing lip, fuel inlet passage for providing fuel injector, and an air passage for air to enter the housing and the openings, whereby during operation, fuel from the fuel injector impinges on an inner surface of the nozzle insert and is pulled towards the atomizing lip from air flow through the nozzle insert from the housing, the air flow through the nozzle insert and air flow through the housing joining at the atomizing lip, resulting in air flows shearing fuel droplets off of the atomizing lip;

swirler means for swirling the air flow through a portion of the housing; and wherein the housing forms a cavity around the fuel injector and the nozzle insert, the air flow through the cavity providing thermal protection for the fuel injector and the nozzle insert.

* * * * *